US010833456B2

(12) United States Patent
Maesoba et al.

(10) Patent No.: US 10,833,456 B2
(45) Date of Patent: Nov. 10, 2020

(54) SHIELD TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/483,507

(22) PCT Filed: Jan. 15, 2018

(86) PCT No.: PCT/JP2018/000740
§ 371 (c)(1),
(2) Date: Aug. 5, 2019

(87) PCT Pub. No.: WO2018/142887
PCT Pub. Date: Aug. 9, 2018

(65) Prior Publication Data

US 2020/0021064 A1 Jan. 16, 2020

(30) Foreign Application Priority Data

Feb. 3, 2017 (JP) ..... 2017-018550

(51) Int. Cl.
*H01R 13/659* (2011.01)
*H01R 13/6593* (2011.01)
(Continued)

(52) U.S. Cl.
CPC ..... *H01R 13/6593* (2013.01); *H01R 4/184* (2013.01); *H01R 13/50* (2013.01);
(Continued)

(58) Field of Classification Search
CPC ..... H01R 13/659; H01R 4/184; H01R 13/50; H01R 13/6582
(Continued)

(56) References Cited

U.S. PATENT DOCUMENTS 5,273,459 A * 12/1993 Davis ..... H01R 13/6593 439/607.48
5,409,400 A * 4/1995 Davis ..... H01R 24/60 439/607.48
(Continued)

FOREIGN PATENT DOCUMENTS

JP 7-254454 10/1995
JP 2012-129103 7/2012
(Continued)

OTHER PUBLICATIONS

International Search Report dated Mar. 20, 2018.

*Primary Examiner* — Alexander Gilman
(74) *Attorney, Agent, or Firm* — Gerald E. Hespos; Michael J. Porco; Matthew T. Hespos

(57) ABSTRACT

A shield terminal (T) includes inner conductors (52) to be connected to front parts of cores (62) of a shielded cable (60), a dielectric (46) configured to accommodate the inner conductors (52), a tubular member (12) forming part of an outer conductor (10) and configured to surround and hold the dielectric (46). Two divided shells (18, 35) have a half-divided shape, are separate from the tubular member (12), and form part of the outer conductor (10). The divided shells (18,35) are to be connected to a front part of a shield layer (65) of the shielded cable (60). A first cover (19) and a second cover (36) are formed on a lower member (18) and an upper member (35) and surround the cores (62) over an entire periphery between a rear end of the tubular member (12) and a front end of the shield layer (65).

5 Claims, 14 Drawing Sheets

(51) Int. Cl.

| | |
|---|---|
| ***H01R 4/18*** | (2006.01) |
| ***H01R 13/50*** | (2006.01) |
| ***H01R 13/6582*** | (2011.01) |
| *H01R 24/28* | (2011.01) |
| *H01R 107/00* | (2006.01) |

(52) U.S. Cl.
CPC ..... *H01R 13/6582* (2013.01); *H01R 24/28* (2013.01); *H01R 2107/00* (2013.01)

(58) Field of Classification Search
USPC ..... 439/607
See application file for complete search history.

(56) References Cited

U.S. PATENT DOCUMENTS 6,659,801 B2 * 12/2003 Nishio ..... H01R 13/6581 439/607.48
7,008,255 B1 * 3/2006 Wang ..... H01R 13/506 439/357
7,465,194 B1 * 12/2008 Ho ..... H01R 9/032 439/607.01
7,618,293 B2 * 11/2009 Wu ..... H01R 24/62 439/493
7,736,190 B2 * 6/2010 Yuan ..... H01R 4/02 439/516
8,303,344 B2 * 11/2012 Xiao ..... H01R 27/02 439/607.24
9,466,928 B2 * 10/2016 Luettermann ..... H01R 13/514
10,381,785 B2 * 8/2019 Maesoba ..... H01R 13/6581
10,505,288 B2 * 12/2019 Naganuma ..... H01R 13/514
2002/0045385 A1 * 4/2002 Wang ..... H01R 13/6593 439/607.48
2016/0093984 A1 * 3/2016 Iwamoto ..... H01R 13/6581 439/607.55

FOREIGN PATENT DOCUMENTS

JP 2012-195315 10/2012
JP 2016-72067 5/2016

* cited by examiner

SHIELD TERMINAL

BACKGROUND

Field of the Invention

The invention relates to a shield terminal.

Related Art

Japanese Unexamined Patent Publication No. 2012-129103 discloses a shield terminal with an outer terminal, an inner terminal and a dielectric. A holding portion is formed in a front part of the outer terminal and the dielectric is held in the holding portion. The inner terminal is mounted in the dielectric, and is connected to a core of a shielded cable. A crimping portion in the form of an open barrel is formed in a rear part of the outer terminal, and is connected to a shield layer of the shielded cable.

The core and the inner terminal are exposed to the outside of the outer terminal in an area of the outer terminal between the holding portion and the crimping portion. Thus, a shielding function may be reduced. As a countermeasure against this, it is considered to form a tubular member for surrounding the core and the inner terminal over the entire periphery between the holding portion and the crimping portion. However, if the tubular member is formed, it is difficult to connect the inner terminal to the core and an assembling operation is restricted with the dielectric and the inner terminal mounted in the holding portion.

The invention was completed on the basis of the above situation and aims to reduce restrictions of an assembling operation and improve the reliability of a shielding function.

SUMMARY

The invention is directed to a shield terminal with an inner conductor to be connected to a front part of a core of a shielded cable, a dielectric configured to accommodate the inner conductor and an outer conductor. The outer conductor includes tubular member surrounds and holds the dielectric. The outer conductor also includes two divided shells having a half-divided shape and provided separate from the tubular member. The divided shells are connected to a front end part of a shield layer of the shielded cable. Two covers are formed on the divided shells and surround the core over an entire periphery between a rear end of the tubular member and a front end of the shield layer. Thus, covers improve the reliability of a shielding function. The divided shells formed with the covers are separate from the tubular member and have the half-divided shape. Thus, an operation of connecting the inner conductor to the core can be performed with the dielectric and the inner conductor mounted in the tubular member. Therefore, restrictions of an assembling process are reduced according to the present invention.

A crimping portion to be crimped to an outer periphery of the shield layer may be formed on a rear end part of at least one of the divided shells, and a hook to be locked to an inner edge of a rear end of the tubular member may be formed on a front end part of the divided shell formed with the crimping portion. A reaction force is generated while crimping the crimping portion to the shield layer and urges the front part of the divided shell radially outward. However, the hook on the front end part of the divided shell is locked to the inner edge of the rear end of the tubular member so that the front part of the divided shell cannot be lifted.

The shield terminal may include a guide means configured to guide the divided shell to a proper assembly position while allowing the divided shell to swing with the hook as a fulcrum. According to this configuration, the guide means enables the divided shell to be assembled without interfering with other members.

The one of the divided shells may be formed with a fixing portion configured to cover a part of the outer periphery of the shield layer, and the other divided shell may be formed with a crimping portion to be crimped to the outer periphery of the shield layer and may include a crimping piece to be crimped to an outer periphery of the fixing portion. According to this configuration, the divided shells can be fixed to the shield layer merely by a process of crimping the crimping portion while crimping the crimping piece to the outer periphery of the fixing portion.

DETAILED DESCRIPTION

Hereinafter, one specific embodiment of the present invention is described with reference to FIGS. 1 to 14. Note that, in the following description, a left side in FIGS. 1 to 14 is defined as a front end concerning front-rear directions of a shield connector 1 and a shield terminal T. Upper and lower sides shown in FIGS. 1 to 14 are defined as upper and lower sides concerning a vertical direction.

Figure 1:
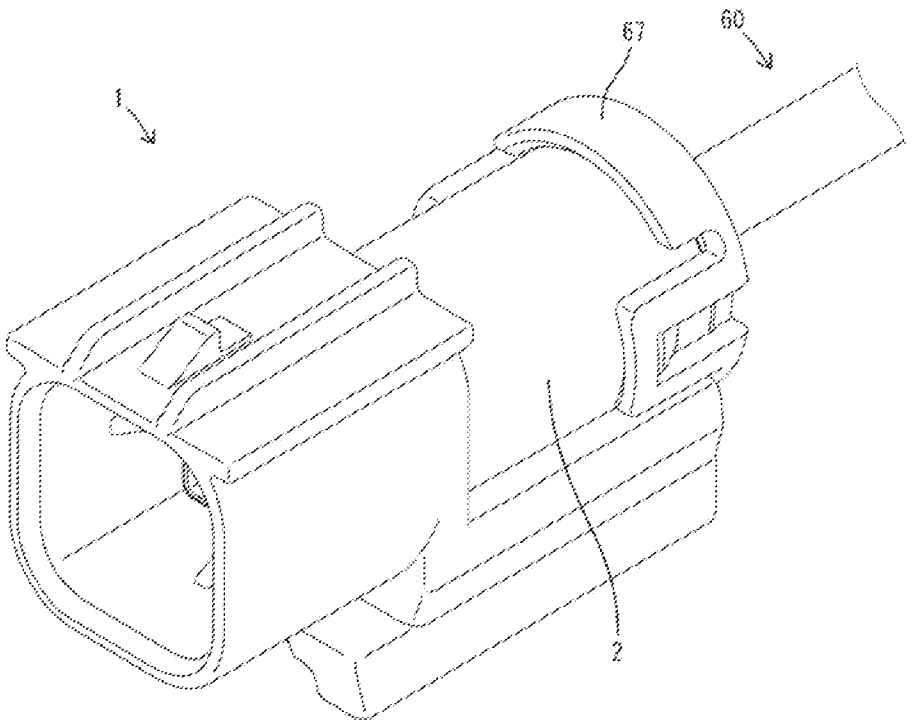
FIG. 1 is a perspective view of a shield connector.
Figure 2:
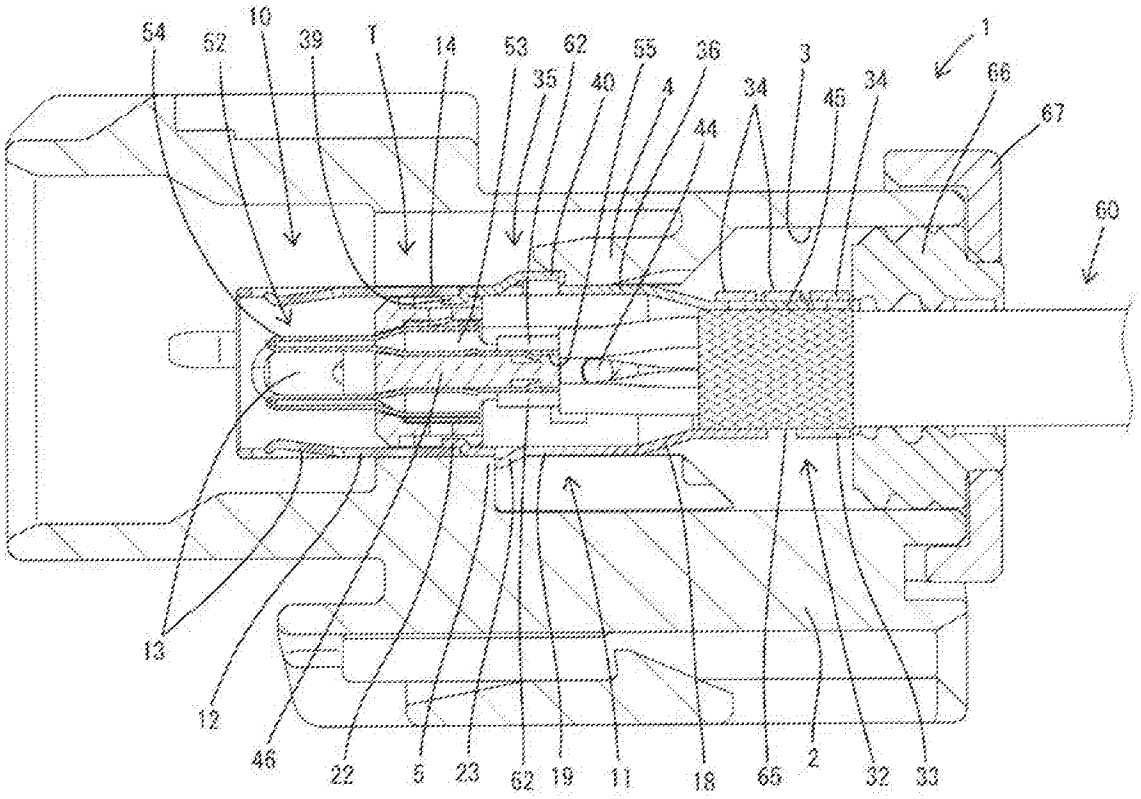
FIG. 2 is a side view in section of the shield connector.

The shield connector 1 includes a housing 2 made of synthetic resin and the shield terminal T. As shown in FIG. 2, a terminal accommodation chamber 3 is formed in the housing 2 and is open on both front and rear ends. The shield terminal T is inserted into the terminal accommodation chamber 3 from behind the housing 2. A resiliently deflectable locking lance 4 is formed at an upper surface of the terminal accommodation chamber 3 for restricting the rearward escape of the shield terminal T inserted into the terminal accommodation chamber 3. Further, a lower surface of the terminal accommodation chamber 3 is formed with a front stop 5 for stopping the shield terminal T inserted into the terminal accommodation chamber 3 to prevent any further forward movement.

Figure 3:
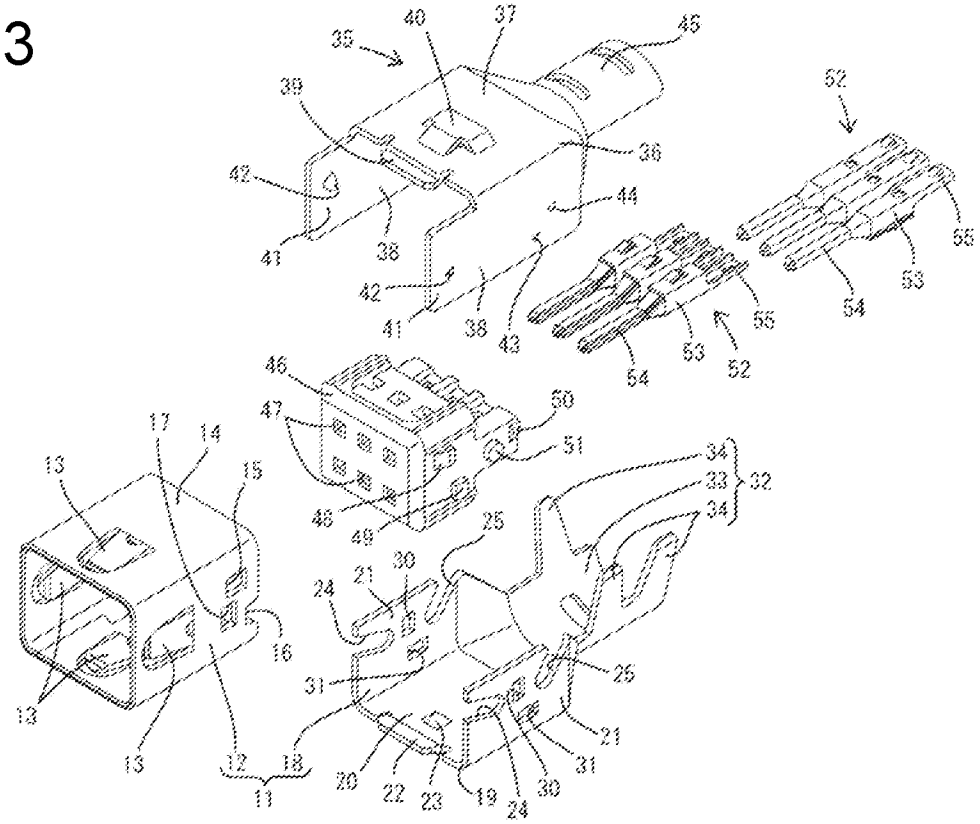
FIG. 3 is an exploded perspective view of a shield terminal.
Figure 4:
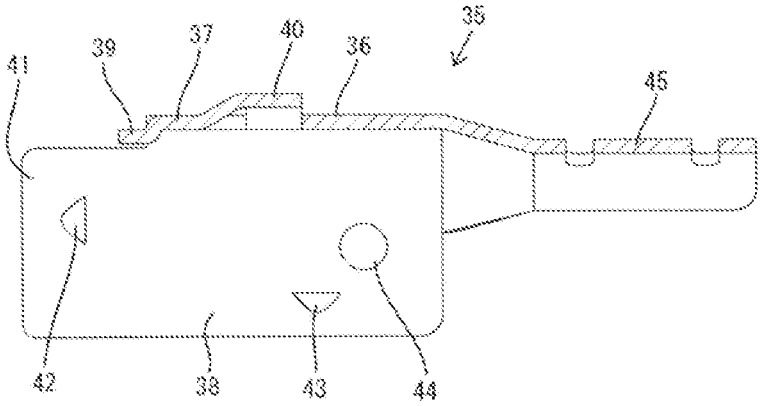
FIG. 4 is a side view in section of an upper member.

As shown in FIG. 3, the shield terminal T is configured by assembling an outer conductor 10 made of metal, a dielectric 46 made of synthetic resin and inner conductors 52 made of metal. The outer conductor 10 is configured by assembling a body 11 and an upper member 35 (other divided shell as claimed). The upper member 35 is a single component separate from the body member 11. The body 11 is configured by assembling a tubular member 12, which is a single component, and a lower member 18 (one divided shell as claimed), which is a single component separate from the tubular member 12. That is, the outer conductor 10 is configured by assembling three components, i.e. the tubular member 12, the upper member 35 and the lower member 18.

The tubular member 12 is a single member formed into a substantially rectangular tube shape by applying bending and the like to a metal plate material having a predetermined shape. The tubular member 12 has sufficient rigidity and shape retention so as not to be expanded and deformed. Four resilient contact pieces 13 are formed respectively in front end areas of four plate parts constituting the tubular member 12. Each resilient contact piece 13 is cantilevered obliquely inward toward the front by cutting and raising a part of each plate part. These resilient contact pieces 13 resiliently contact the outer peripheral surface of a mating outer conductor (not shown).

A rear end area of the tubular member 12 is a substantially rectangular tube that functions as a holding portion 14 for holding the dielectric 46. As shown in FIG. 3, a first locking portion 15 in the form of a window, a second locking portion 16 formed by cutting the rear end edge of the holding portion 14 and a third locking portion 17 in the form of a window are formed in each of the left and right side plate parts of the holding portion 14. The second locking portions 16 are at positions below and behind the first locking portions 15. The third locking portions 17 are at positions below the first locking portions 15 and in front of the second locking portions 16.

The lower member 18 is formed by applying bending and the like to a metal plate. A front area of the lower member 18 serves as a first cover 19 in which left and right inner plate parts 21 rise from both left and right side edges of a lower plate part 20. A first hook 22 is formed on the lower plate part 20 of the first cover 19. The first hook 22 is in the form of a rib projecting along a front end edge and is shaped into a step ascending with respect to the lower plate part 20 in a side view. The lower plate part 20 of the first cover 19 is formed with a butting portion 23 struck to project down (outward of the lower plate part 20).

First and second guide grooves 24 and 25 are formed in each of the left and right inner plate parts 21 of the first cover 19. The first guide groove 24 is formed by being cut obliquely down toward the rear from an upper end part of the front end edge of the inner plate part 21 and the second guide groove 25 is formed by being cut obliquely down toward the front from an upper end part of the rear edge of the inner plate part 21. A first stopper 26 in the form of a projection is formed at a position of an upper edge part of the first guide groove 24 near a rear end (back end). A second stopper 27 in the form of a projection is formed at a position of an upper edge part of the second guide groove 25 near a front end (back end). The first guide grooves 24 constitute a first guide means 28, and the second guide grooves 25 constitute a second guide means 29.

A fourth locking portion 30 in the form of a window and a fifth locking portion 31 in the form of a window are formed in each of the left and right inner plate parts 21 of the first cover 19. The fourth and fifth locking portions 30, 31 are in a vertically arranged positional relationship, and the fifth locking portion 31 is disposed at a position below the fourth locking portion 30. The fourth and fifth locking portions 30, 31 are disposed between the rear end of the first guide groove 24 and the front end of the second guide groove 25 in the front-rear direction.

A crimping portion 32 in the form of an open barrel is formed on a rear end area of the lower member 18. The crimping portion 32 includes a base plate part 33 having a substantially arcuate cross-section and extending rearward from the rear end of the lower plate part 20 of the first cover 19 and two bilaterally asymmetrical crimping pieces 34 rising from both left and right side edges of the base plate part 33. The crimping portion 32 is fixed conductively to the outer periphery of a shield layer 65 of a shielded cable 60.

The upper member 35 is formed by applying bending and the like to a metal plate. A front area of the upper member 35 serves as a second cover 36 in which left and right outer plate parts 38 extend down from both left and right sides of an upper plate part 37. A second hook 39 is formed on the upper plate part 37 of the second cover 36. The second hook 39 is in the form of a rib projecting along a front edge and is shaped into a step descending with respect to the upper plate part 37 in a side view. The upper plate part 37 is formed with a retaining projection 40 struck to project up (outward of the upper plate part 37).

Front end parts of the both left and right outer plate parts 38 of the second cover 36 project farther forward than the second hook 39 (front end of the upper plate part 37) and function as closing plates 41. A third locking projection 42, a fifth locking projection 43 and a second guide pin 44 project inward on each of the left and right outer plate parts 38. The third locking portions 17 are on front parts (closing plate parts 41) of the outer plate parts 39. The fifth locking portions 31 are at positions behind the second hook 39. The second guide pins 44 are at positions behind and above the fifth locking portions 31. The second guide pins 44 constitute the second guide means 29.

A rear area of the upper member 35 is formed with a fixing portion 45 extending rearward from the rear end of the upper plate part 37. The fixing portion 45 has a substantially arcuate cross-sectional shape to face the crimping portion 32 of the lower member 18 from above. The fixing portion 45 is disposed to vertically sandwich a front part of the shield layer 65 of the shielded cable 60 between the crimping portion 32 and the fixing portion 45.

The dielectric 46 is made of synthetic resin and is in the form of a block. Conductor accommodation chambers 47 are formed inside the dielectric 46 and are elongated in the front-rear direction. The conductor accommodation chambers 47 are disposed in two separate upper and lower stages and vertically symmetrical. Rear parts of the conductor accommodation chambers 47 in the upper stage are exposed to an upper-outer side and rear parts of the conductor accommodation chambers 47 in the lower stage are exposed to a lower-outer side.

A first locking projection 48, a second locking projection 49, a fourth locking projection 50 and a first guide pin 51 are formed on each of the left and right side surfaces of the dielectric 46. The first locking projections 48 are at upper end positions on front end parts of outer side surfaces of the dielectric 46. The second locking projections 49 are at positions below and slightly behind the first locking projections 48. The fourth locking projections 50 are on rear end parts of the outer side surfaces of the dielectric 46. The first guide pins 51 are at positions behind the first and second locking projections 48, 49 and in front of the fourth locking projections 50. The first guide pins 51 constitute the first guide means 28.

The inner conductor 52 is made of a metal material and has an elongated shape in the front-rear direction. The inner conductor 52 is formed with a conductor body 53 in the form of a rectangular tube, an elongated tab 54 cantilevered forward from the conductor body 53 and a wire connecting portion 55 extending rearward from the conductor body 53. Each inner conductor 52 is accommodated into the conductor accommodation chamber 47 from behind the dielectric 46. The inner conductors 52 inserted in the conductor accommodation chambers 47 in the upper stage and the inner conductors 52 inserted in the conductor accommodation chambers 47 in the lower stage are oriented vertically symmetrically.

With the inner conductors 52 mounted in the dielectric 46, the conductor bodies 53 are held in the conductor accommodation chambers 47 and the tabs 54 project forward from the front surface of the dielectric 46. Further, the wire connecting portions 55 are exposed upward of the dielectric 46 in the conductor accommodation chambers 47 in the upper stage, and the wire connecting portions 55 are exposed downward of the dielectric 46 in the conductor accommodation chambers 47 in the lower stage. Cores 62 of the shielded cable 60 are connected to the respective wire connecting portions 55 by soldering.

The shielded cable 60 to which the shield terminal T is connected includes thin coated wires 61, the shield layer 65 formed of a braided wire for surrounding the coated wires 61 in a bundled state and a hollow cylindrical sheath 64 surrounding the shield layer 65. The coated wire 61 is composed of the core 62 and an insulation coating 63 surrounding the core 62, and extends forward from the front end of the sheath 64. A front part of the core 62 is exposed by removing the insulation coating 63. A front part of the shield layer 65 extending from the front end of the sheath 64 is folded rearward on an outer peripheral side to cover the outer periphery of the sheath 64.

Figure 5:
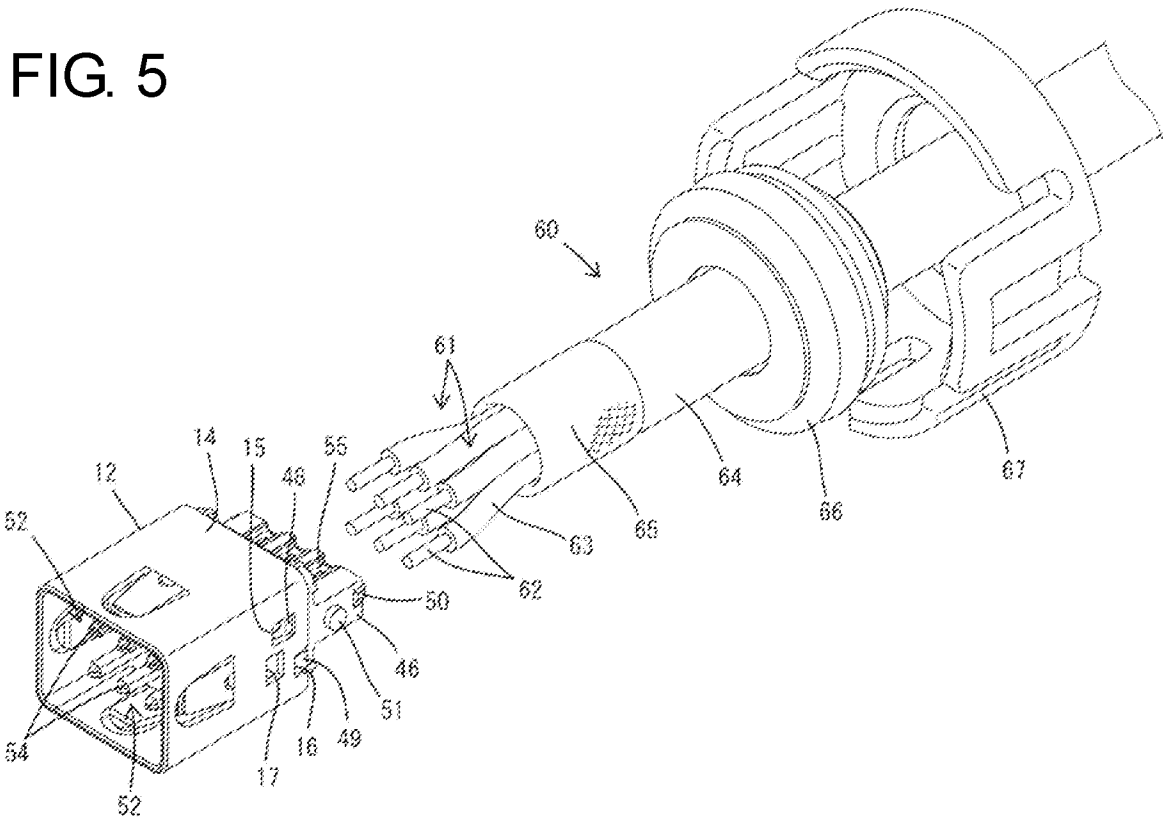
FIG. 5 is a perspective view showing a state before inner conductors and cores are connected.

Next, an assembling procedure of the shield connector 1 of this embodiment is described. First, the inner conductors 52 are mounted into the dielectric 46 and, thereafter, the dielectric 46 is inserted into the tubular member 12 from behind. As shown in FIG. 5, with the dielectric 46 mounted in the tubular member 12, the front area of the dielectric 46 is fit in the holding portion 14 of the tubular member 12 and the tabs 54 are surrounded collectively by the tubular member 12.

The tubular member 12 and the dielectric 46 are held in the assembled state by the locking of the first locking portions 15 with the first locking projections 48 and by the locking of the second locking portions 16 with the second locking projections 49. That is, the tubular member 12 and the dielectric 46 are positioned with relative displacements restricted in the front-rear direction, vertical direction and lateral direction. Further, the fourth locking projections 50, the first guide pins 51 and the wire connecting portions 55 of the inner conductors 52 are exposed at positions behind the tubular member 12.

After the dielectric 46 is mounted into the tubular member 12, the front end parts of the cores 62 of the shielded cable 60 are connected conductively to the wire connecting portions 55 of the respective inner conductors 52 by soldering. At this time, the cores 62 are placed into the wire connecting portions 55 in the upper stage from above and soldered. The cores 62 are placed into and soldered to the wire connecting portions 55 in the lower stage with the dielectric 46 and the tubular member 12 vertically inverted.

Figure 6:
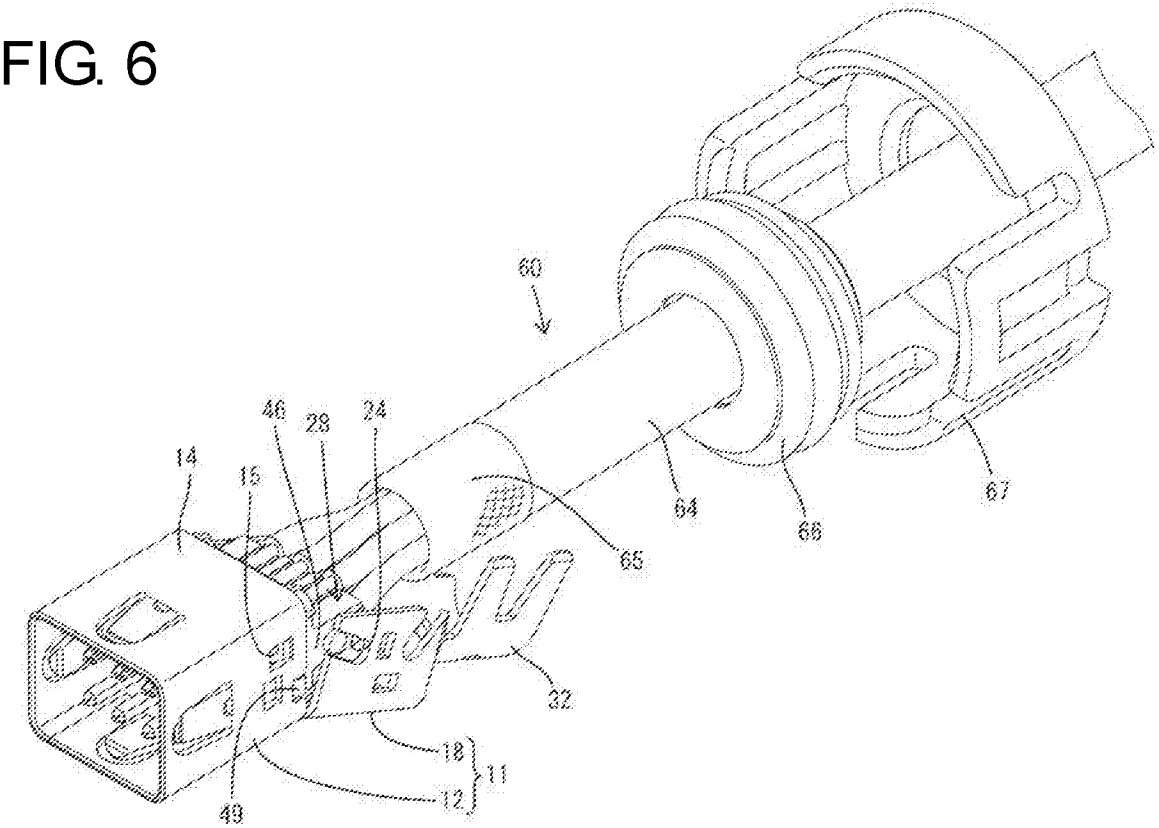
FIG. 6 is a perspective view showing a state where a lower member is being assembled with a tubular member and a dielectric.
Figure 7:
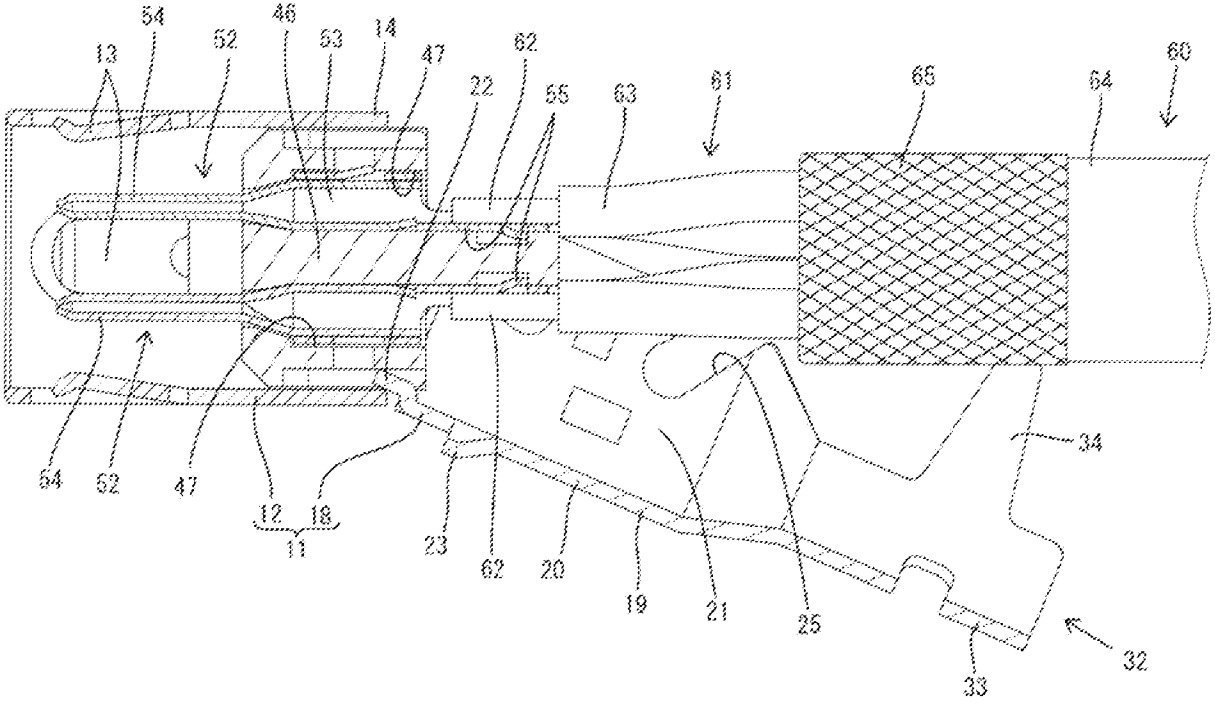
FIG. 7 is a side view in section showing the state where the lower member is being assembled with the tubular member and the dielectric.

After all the cores 62 are connected to the wire connecting portions 55, the lower member 18 is assembled with the tubular member 12 and the dielectric 46. In mounting the lower member 18, the first guide pins 51 are caused to enter the entrances at front ends of the first guide grooves 24 and the first hook 22 of the lower member 18 is locked to a lower edge of the rear end of the tubular member 12 (holding portion 14), as shown in FIGS. 6 and 7. The lower member 18 then is swung up with the locking position as a fulcrum. A swing direction of the lower member 18 during this assembling operation is a direction intersecting an axis of the shielded cable 60.

Figure 8:
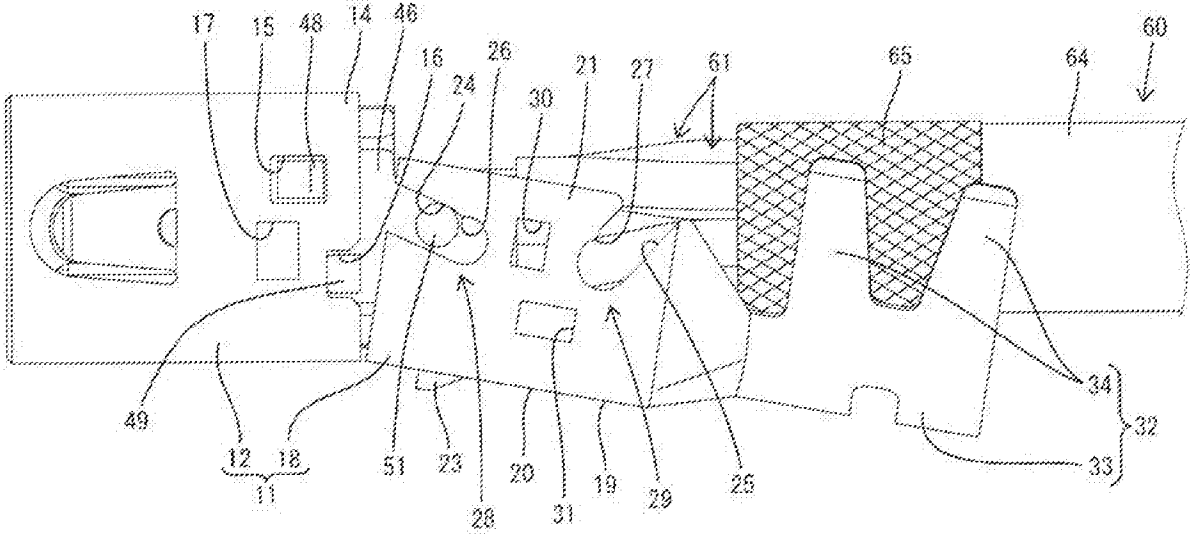
FIG. 8 is a side view showing the state where the lower member is being assembled with the tubular member and the dielectric.
Figure 9:
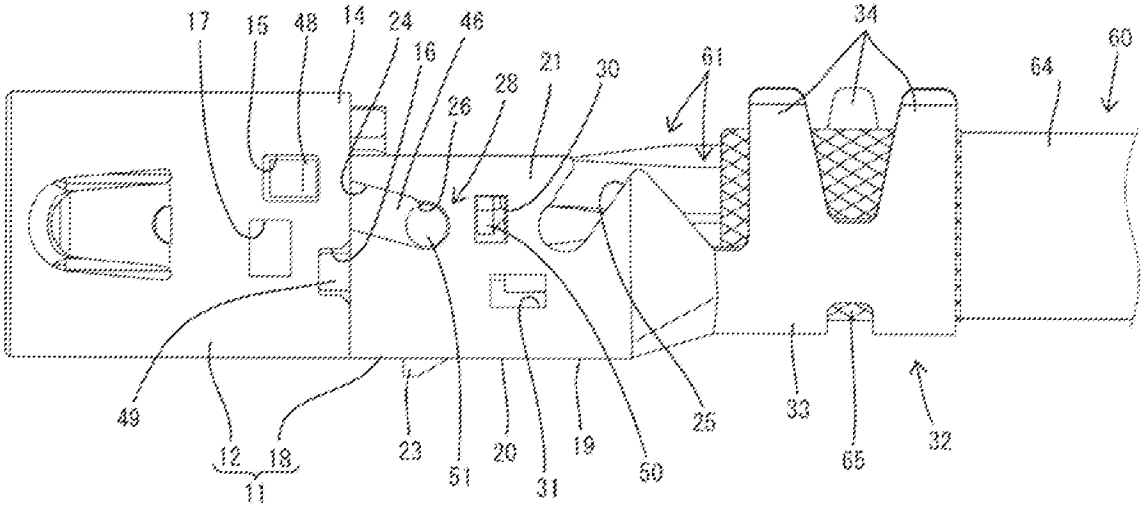
FIG. 9 is a side view showing a state where the lower member is assembled with the tubular member and the dielectric.

In the process of swinging the lower member 18, the first guide pins 51 slide along edges of the first guide grooves 24, as shown in FIG. 8. Thus, a swing trajectory of the lower member 18 is stabilized in the vertical direction and front-rear direction. Further, the left and right inner plate parts 21 slide in contact with the outer side surfaces of the dielectric 46 so that the lower member 18 is positioned in the lateral direction with respect to the dielectric 46 and the tubular member 12. As shown in FIG. 9, when the first guide pins 51 reach the back ends of the first guide grooves 24, the assembling of the lower member 18 with the tubular member 12 and the dielectric 46 is completed and the body 11 of the outer conductor 10 is configured.

With the assembling of the body member 11 completed, the first guide pins 51 are locked to the first stoppers 26 to be held in back ends of the first guide grooves 24. Additionally, the first hook 22 is locked conductively to the rear edge of the tubular member 12 and the fourth locking portions 30 and the fourth locking projections 50 are locked to each other. Thus, the lower member 18, the tubular member 12 and the dielectric 46 are held in the assembled state with relative displacements in the front-rear direction and vertical direction restricted.

With the lower member 18 mounted on the tubular member 12 and the dielectric 46, an area of the lower member 18 except the first hook 22 is entirely behind and continuous with the tubular member 12. Further, the first cover 19 of the lower member 18 covers side surfaces of the dielectric 46 in an area behind the tubular member 12, exposed areas of the front end parts of the cores 62 and the wire connecting portions 55 of the inner conductors 52 mounted in the conductor accommodation chambers 47 in the lower stage. Further, the crimping portion 32 is covers a lower surface area of the outer periphery of the front part of the shield layer 65.

Figure 10:
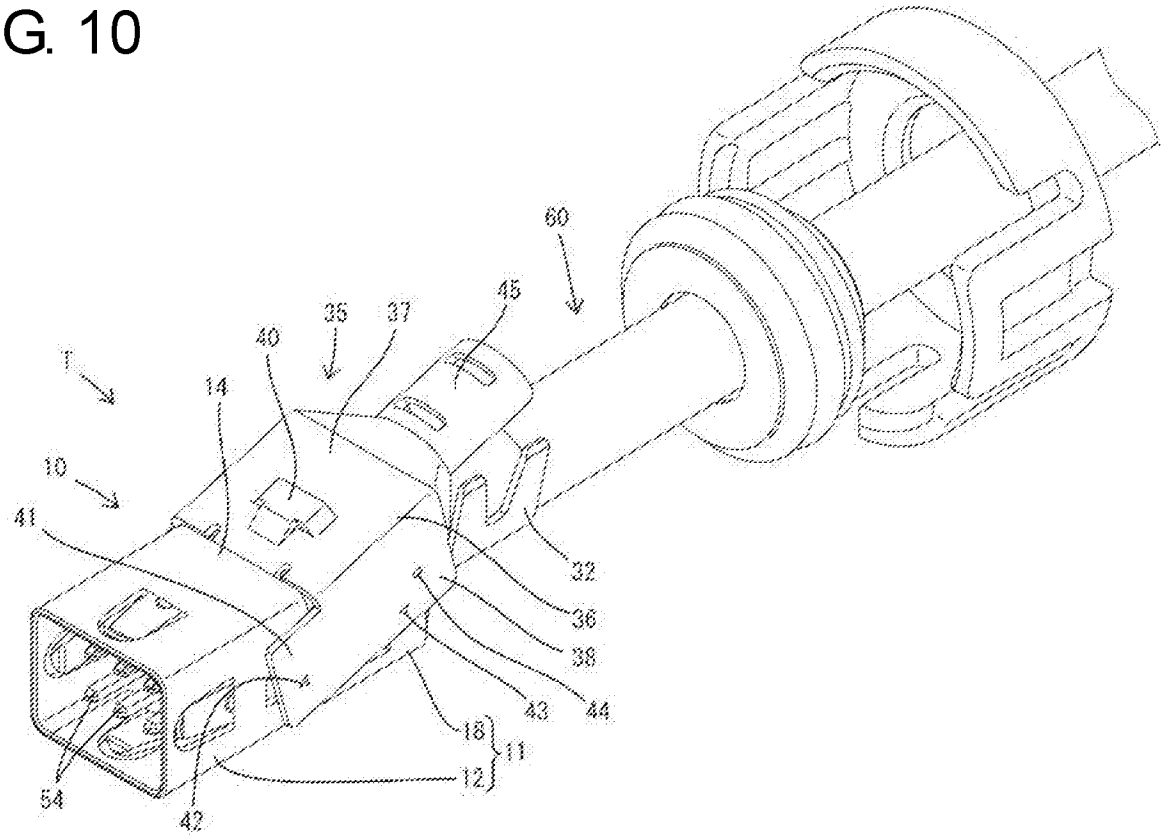
FIG. 10 is a perspective view showing a state where the upper member is being assembled with the tubular member and the lower member.
Figure 11:
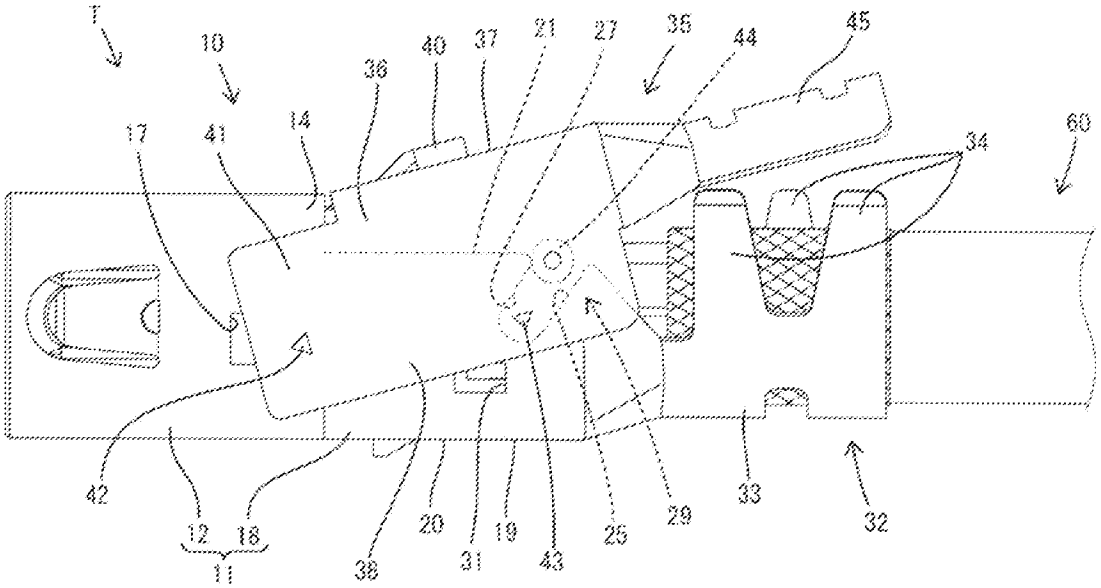
FIG. 11 is a side view showing the state where the upper member is being assembled with the tubular member and the lower member.
Figure 12:
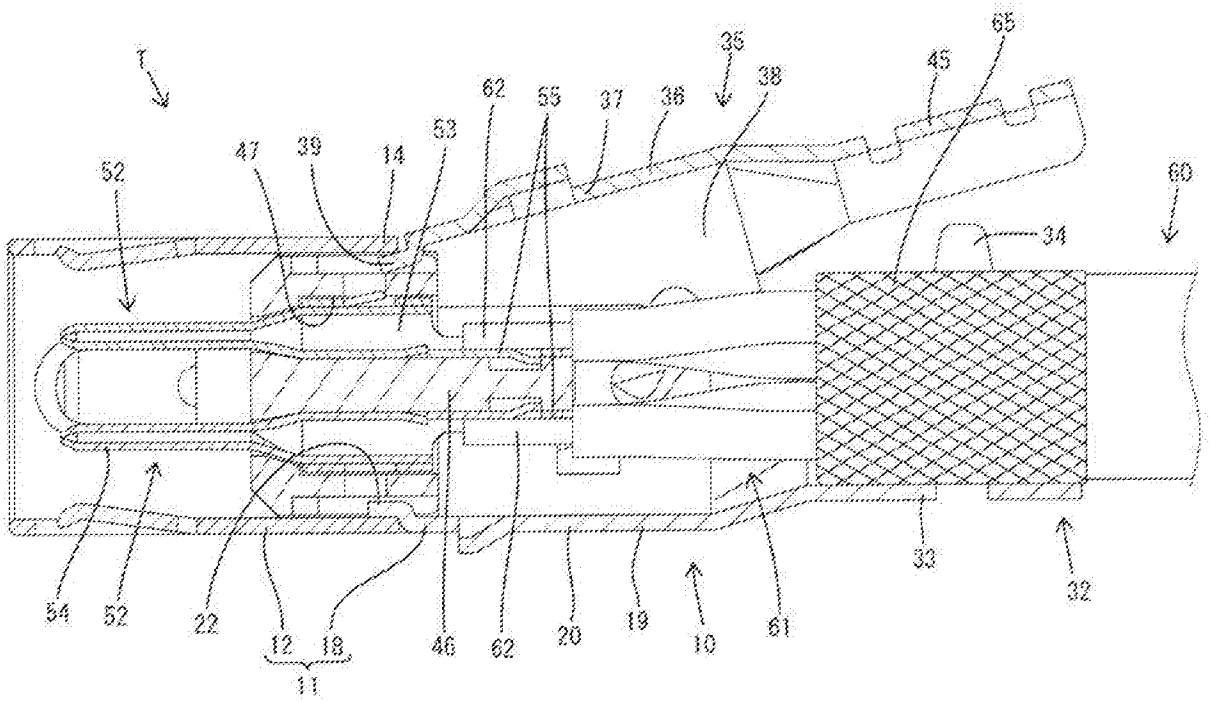
FIG. 12 is a side view in section showing the state where the upper member is being assembled with the tubular member and the lower member.

Thereafter, the upper member 35 is assembled with the body 11. In mounting the upper member 35, the second guide pins 44 are caused to enter the entrances of the second guide grooves 25 and the second hook 39 of the upper member 35 is locked to an upper edge of the rear end of the tubular member 12 (holding portion 14), as shown in FIGS. 10, 11 and 12. Additionally, the upper member 35 is swung down with the locking position as a fulcrum. A swing direction during this assembling operation is a direction intersecting the axis of the shielded cable 60.

Figure 13:
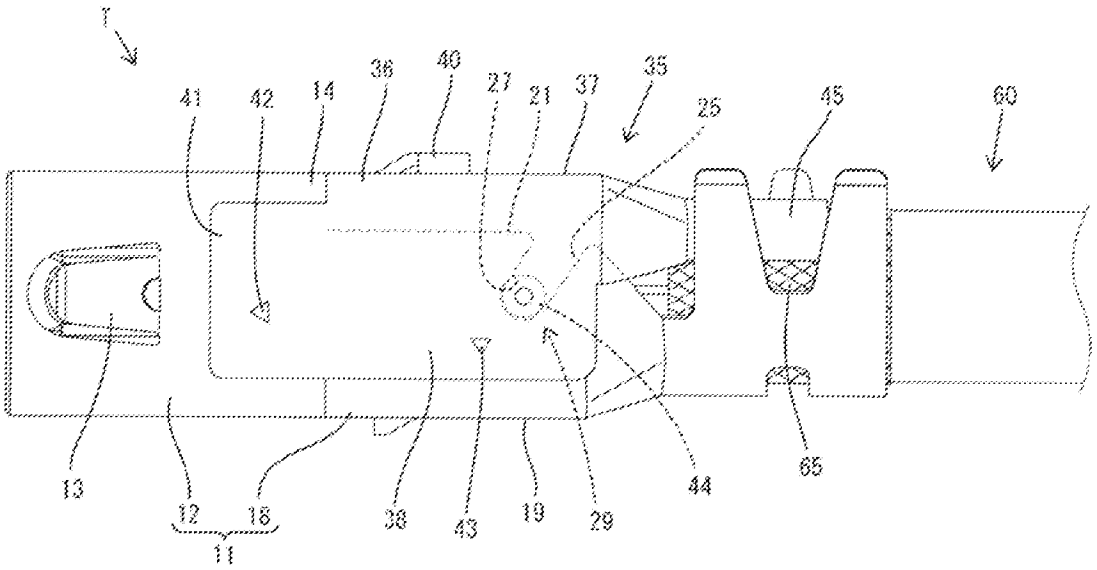
FIG. 13 is a side view showing a state where the assembling of the tubular member, the lower member and the upper member is completed.

In the process of swinging the upper member 35, the second guide pins 44 slide along edges of the second guide grooves 25 to stabilize a swing trajectory of the upper member 35 in the vertical direction and front-rear direction. Further, the left and right outer plate parts 38 slide in contact with the outer surfaces of the inner plate parts 21 of the lower member 18 to position the upper member 35 in the lateral direction with respect to the body 11. As shown in FIG. 13, when the second guide pins 44 reach the back ends of the second guide grooves 25, the assembling of the upper member 35 with the body 11 is completed and the shield terminal T is configured.

With the assembling of the upper member 35 completed, the second guide pins 44 are locked to the second stoppers 27, thereby being held in back ends of the second guide grooves 25, the second hook 39 is locked conductively to the rear edge of the tubular member 12, the third locking portions 17 and the third locking projections 42 are locked conductively to each other, and the fifth locking portions 31 and the fifth locking projections 43 are locked conductively to each other. Thus, the body 11 and the upper member 35 are held in the assembled state with relative displacements in the front-rear direction and vertical direction restricted.

With the upper member 35 mounted on the body member 11, an area of the upper member 35 except the second hook 39 is located entirely behind and continuous with the tubular member 12. Additionally, the upper member 35 and the lower member 18 are positioned to vertically face each other across the front end part of the shielded cable 60 and the rear end part of the dielectric 46. Further, the second cover 36 of the upper member 35 covers: an inner side part of the first cover 19, the exposed areas of the front end parts of the cores 62 and the wire connecting portions 55 of the inner conductors 52 mounted in the conductor accommodation chambers 47 in the upper stage.

Further, the closing plates 41 of the upper member 35 cover locking parts of the first locking portions 15 with the first locking projections 48, locking parts of the second locking portions 16 with the second locking projections 49, the third locking portions 17, locking parts of the fourth locking portions 30 with the fourth locking projections 50, the fifth locking portions 31, fitting parts of the first guide grooves 24 with the first guide pins 51 and fitting parts of the second guide grooves 25 with the second guide pins 44.

The first and second covers 19, 36 are connected conductively in locking parts of the third locking portions 17 with the third locking projections 42 and locking parts of the fifth locking portions 31 with the fifth locking projections 43. The front end parts of the cores 62 and the wire connecting portions 55 of the inner conductors 52 are surrounded over the entire periphery by the first and second covers 19, 36 to define a shielding function between the rear end of the tubular member 12 and the front end of the shield layer 65.

Figure 14:
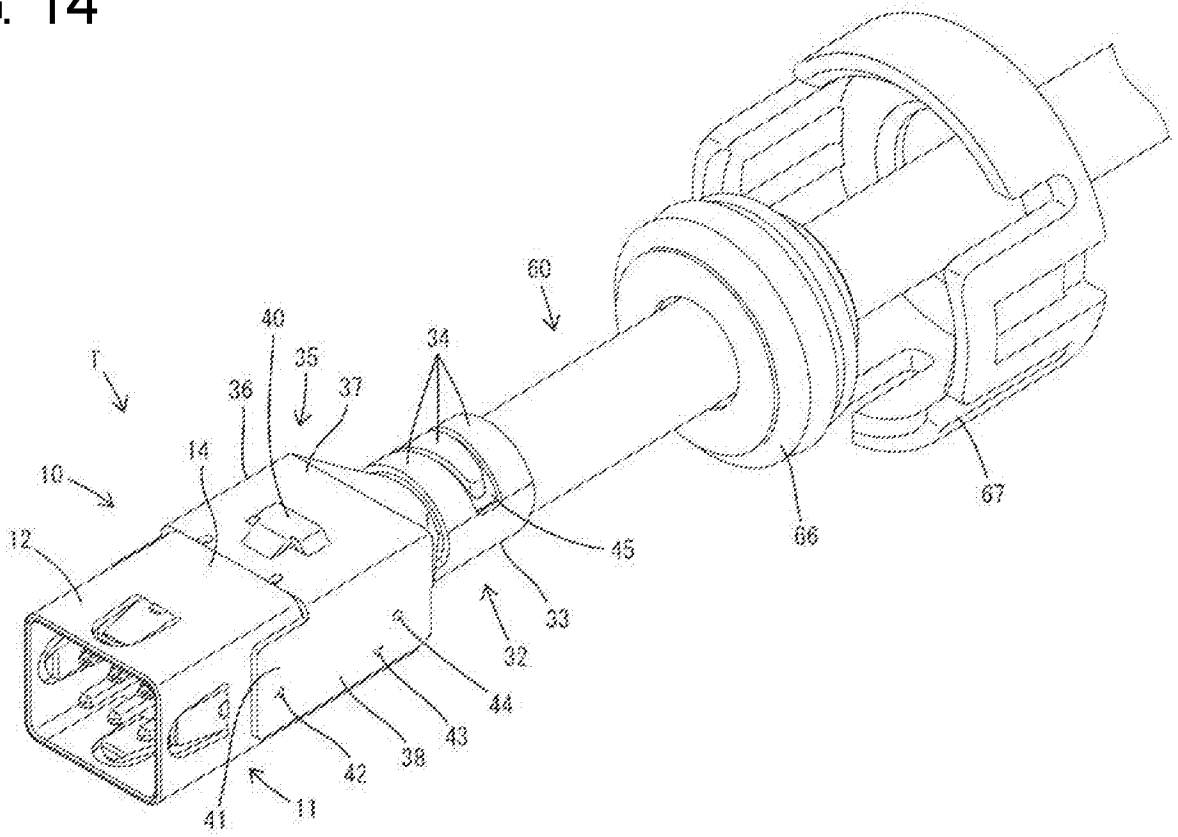
FIG. 14 is a perspective view of the shield terminal showing the state where the assembling of the tubular member, the lower member and the upper member is completed.

Further, the fixing portion 45 is located to cover an upper surface area of the outer periphery of the front part of the shield layer 65 and vertically sandwiches the front part of the shield layer 65 between the crimping portion 32 and the fixing portion 45. After the upper member 35 is assembled, the crimping portion 32 is crimped to the outer peripheries of the fixing portion 45 and the shield layer 65, as shown in FIG. 14. During crimping, the crimping pieces 34 are crimped into close contact with the outer periphery of the fixing portion 45. In this way, the inner peripheral surface of the base plate part 33 of the crimping portion 32 and the inner peripheral surface of the fixing portion 45 entirely surround the outer periphery of the shield layer 65 and are fixed conductively. In the above way, the assembling of the shield terminal T is completed.

Thereafter, the shield terminal T is inserted into the housing 2 from behind. Any further forward movement of the shield terminal T in an inserting direction is restricted by the butting portion 23 butting against the front stop 5 and the rearward escape thereof is restricted by locking the retaining projection 40 by the locking lance 4 so that the shield terminal T is retained and held. A rubber plug 66 and a rear holder 67 externally fit on the shielded cable 60 in advance then are mounted in a rear part of the housing 2 to complete the assembling of the shield connector 1.

The shield terminal T of this embodiment includes the inner conductors 52 to be connected to the front parts of the cores 62 of the shielded cable 60, the dielectric 46 for accommodating the inner conductors 52, the outer conductor 10 and the first guide means 28. The outer conductor 10 includes the tubular member 12 for surrounding and holding the dielectric 46, and the lower member 18 separate from the tubular member 12 and having the crimping portion 32 connectable to the shield layer 65 of the shielded cable 60. The first hook 22 is formed on the front end part of the lower member 18 and is lockable to the rear edge of the tubular member 12. The first guide means 28 guides the lower member 18 to a proper assembly position while allowing the lower member 18 to swing with the first hook 22 as a fulcrum.

Since the dielectric 46 is surrounded by the tubular member 12 in the shield terminal T of this embodiment, the reliability of the shielding function is high. Further, since the crimping portion 32 is not present behind the tubular member 12 in a state before the lower member 18 is assembled with the tubular member 12, work efficiency when mounting the dielectric 46 into the tubular member 12 from behind is good. Further, since the lower member 18 is guided by the first guide means 28 in assembling the lower member 18 with the tubular member 12, work efficiency is good.

Further, the crimping portion 32 is an open barrel and is crimped to the outer periphery of the shield layer 65. The first hook 22 is locked to an inner peripheral edge of the tubular member 12. A reaction force is generate when crimping the crimping portion 32 to the shield layer 65 and urges the front part of the lower member 18 radially outward. However, the first hook 22 formed on the front part of the lower member 18 is locked to the inner edge of the rear end of the tubular member 12 so that the front part of the lower member 18 cannot lift out.

The first guide means 28 is formed in the lower member 18 and the dielectric 46. Thus, the shape of the tubular member 12 can be simplified as compared to the case where the tubular member 12 is formed with a guide means. Further, the first guide means 28 is composed of the first guide pins 51 formed on the dielectric 46 and the first guide grooves 24 formed in the lower member 18. The first guide pins 51 slide in contact with the first guide grooves 24. According to this configuration, the tubular member 12 need not be formed with any guide means. Thus, the shape of the tubular member 12 can be simplified.

The shield terminal T of this embodiment includes the outer conductor 10 and the second guide means 29. The outer conductor 10 is configured by assembling the body 11 and the upper member 35. The body 11 includes the tubular holding portion 14 for surrounding and holding the dielectric 46 and the crimping portion 32 to be connected to the front end part of the shield layer 65 of the shielded cable 60. The upper member 35 is separate from the body 11 and surrounds the cores 62 over the entire periphery together with the body 11 between the rear end of the holding portion 14 and the front end of the shield layer 65. The body 11 and a cover surround the cores 62 over the entire periphery between the rear end of the holding portion 14 and the front end of the shield layer 65. Thus, the reliability of the shielding function is improved.

Further, the second hook 39 lockable to the rear edge of the holding portion 14 is formed on the front part of the upper member 35. The second guide means 29 guides the upper member 35 to a proper assembly position while allowing the upper member 35 to swing with the second hook 39 as a fulcrum. According to this configuration, work efficiency is good since the upper member 35 is guided by the second guide means 29 in assembling the upper member 35 with the body 11.

Further, the upper member 35 is formed with the fixing portion 45 to be crimped to the outer periphery of the shield layer 65, and the second hook 39 is locked to an inner peripheral edge of the holding portion 14. Reaction forces are generated when crimping the fixing portion 45 to the shield layer 65 and urge the front end part of the upper member 35 radially outward. However, the second hook 39 on the front part of the upper member 35 is locked to the inner edge of the rear end of the holding portion 14 so that the front end part of the upper member 35 cannot lift.

Further, the body 11 is configured by assembling the tubular member 12 formed with the holding portion 14 and the lower member 18 formed with the crimping portion 32. According to this configuration, since the crimping portion 32 is not present behind the tubular member 12 in the state before the lower member 18 is assembled with the tubular member 12, work efficiency in mounting the dielectric 46 into the tubular member 12 from behind is good.

Further, the second guide means 29 is formed in the upper member 35 and the lower member 18. Thus, the shape of the tubular member 12 can be simplified as compared to the case where the tubular member 12 is formed with a guide means. Further, the second guide means 29 is composed of the second guide pins 44 formed on the upper member 35 and the second guide grooves 25 formed in the lower member 18. The second guide pins 44 slide in contact with the second guide grooves 25. According to this configuration, the tubular member 12 need not be formed with any guide means, and the shape of the tubular member 12 can be simplified.

The outer conductor 10 of the shield terminal T includes the tubular member 12 for surrounding and holding the dielectric 46, the lower member 18 separate from the tubular member 12 and to be connected to the front end part of the shield layer 65 of the shielded cable 60, and the upper member 35 to be connected to the front end part of the shield layer 65. The lower member 18 and the upper member 35 constitute two divided shells. The lower member 18 and the upper member 35 are formed with the first cover 19 and the second cover 36 for surrounding the cores 62 and the wire connecting portions 55 of the inner conductors 52 over the entire periphery between the rear end of the tubular member 12 and the front end of the shield layer 65.

According to this configuration, the first and second coves 19, 36 surround the cores 62 and the wire connecting portions 55 over the entire periphery between the rear end of the tubular member 12 and the front end of the shield layer 65, the reliability of the shielding function is high. Further, the divided shells (lower member 18 and upper member 35) formed with the first and second covers 19, 36 are separate from the tubular member 12. Thus, with the dielectric 46 and the inner conductors 52 mounted in the tubular member 12, an operation of connecting the inner conductors 52 to the cores 62 can be performed. Therefore, the shield terminal T of this embodiment can reduce restrictions of the assembling process.

Further, the crimping portion 32 to be crimped to the outer periphery of the shield layer 65 is formed on the rear end part of the lower member 18, and the first hook 22 to be locked to the inner edge of the rear end of the tubular member 12 is formed on the front part of the lower member 18 formed with the crimping portion 32. According to this configuration, reaction forces generated when crimping the crimping portion 32 to the shield layer 65 urge the lower member 18 outward. However, the first hook 22 formed on the front part of the lower member 18 is locked to the inner edge of the rear part of the tubular member 12 from inside. Thus, the front part of the lower member 18 cannot be lifted radially outward.

Further, the shield terminal T includes the first guide means 28. The first guide means 28 guides the lower member 18 to the proper assembly position while allowing the lower member 18 to swing with the first hook 22 as a fulcrum. Thus, the first guide means 28 enables the lower member 18 to be assembled with the tubular member 12 and the dielectric 46 without interfering with other members.

Further, the upper member 35 is formed with the fixing portion 45 for covering a part of the outer periphery of the shield layer 65. The lower member 18 is formed with the crimping portion 32 to be crimped to the outer periphery of the shield layer 65 and including the crimping pieces 34 to be crimped to the outer periphery of the fixing portion 45. According to this configuration, the lower member 18 and the upper member 35 can be fixed to the shield layer 65 merely by crimping the crimping portion 32 while crimping the crimping pieces 34 to the outer periphery of the fixing portion 45

The invention is not limited to the above described and illustrated embodiment. For example, the following embodiments also are included in the scope of the invention.

Although the hooks are formed on both the lower member (first divided shell formed with the crimping portion) and the upper member (second divided shell formed with no crimping portion) in the above embodiment. Thus, a hook may be formed only on either one of the lower member and the upper member or may be formed on neither one of the lower member and the upper member.

The hooks function as swing fulcrums in assembling the lower member and the upper member with the tubular member in the above embodiment. However, the lower member and the upper member may be assembled with the tubular member without being swung.

The crimping portion is formed only on the lower member (one divided shell) in the above embodiment. However, a crimping portion may be formed only on the upper member or crimping portions may be formed on both the lower member and the upper member.

Although both the lower member and the upper member are fixed to the shield layer only by the process of crimping the crimping portion of the lower member in the above embodiment, a process of fixing the upper member to the shield layer may be performed separately from a process of crimping the lower member to the shield layer.

The inner conductors and the cores are connected with the inner conductors mounted in the dielectric in the above embodiment. However, the invention can be applied also when the inner conductors are mounted into the dielectric after being connected to the cores.

Although the inner conductor is a male terminal including an elongated tab in a front end part in the above embodiment, the present invention can be applied also when the inner conductor is a female terminal including a rectangular tube in a front end part.

LIST OF REFERENCE SIGNS

T . . . shield terminal
10 . . . outer conductor
12 . . . tubular member
18 . . . lower member (one divided shell)
19 . . . first covering portion (covering portion)
22 . . . first hooking portion (hooking portion)
28 . . . first guide means (guide means)
29 . . . second guide means (guide means)
32 . . . crimping portion
34 . . . crimping piece
35 . . . upper member (other divided shell)
36 . . . second covering portion (covering portion)
39 . . . second hooking portion (hooking portion)
45 . . . fixing portion
46 . . . dielectric
52 . . . inner conductor
60 . . . shielded cable
62 . . . core
65 . . . shield layer

The invention claimed is:

1. A shield terminal, comprising:

an inner conductor to be connected to a front part of a core of a shielded cable;

a dielectric configured to accommodate the inner conductor;

a tubular member constituting part of an outer conductor, the tubular member surrounding and holding the dielectric;

a lower cover member covering at least a lower portion of the tubular member, the lower cover member having a base plate and first and second side plates projecting from the base plate and spaced from each other, at least one guide groove formed in each of the first and second side plates at positions aligned with each other in a front to back direction; and an upper cover member being connected to the lower cover member with the tubular member disposed therebetween, the upper cover member having an upper plate and first and second closing plates projecting form the upper plate, at least first and second guide pins formed on inner surfaces of the first and second closing plates at positions facing each other, wherein the upper cover member is fit at least partially over the lower cover member, with the first and second guide pins fit into the first and second guide grooves respectively, the first and second guide pins sliding along the first and second guide grooves to fully connect the upper and lower cover members.

2. The shield terminal of claim 1, wherein each of the at least one guide groove being open at upper edges of the first and second side plates and extend to positions between the upper edges and the base plate.

3. The shield terminal of claim 1, wherein:

a crimping portion to be crimped to an outer periphery of the shield layer is formed on a rear end part of at least one of the upper and lower cover members; and a hook to be locked to an inner edge of a rear end part of the tubular member is formed on a front part of the at least one of the upper and lower cover members formed with the crimping portion.

4. The shield terminal of claim 3, comprising a guide means composed of the first and second guide pins and the first and second guide grooves, the guide means guiding the upper and lower cover members to a proper assembly position while allowing the divided shell to swing with the hooking portion as a fulcrum.

5. The shield terminal of claim 1, wherein:

one of the upper and lower cover members is formed with a fixing portion configured to cover a part of the outer periphery of the shield layer; and the other of the upper and lower cover members is formed with a crimping portion to be crimped to the outer periphery of the shield layer and including a crimping piece to be crimped to an outer periphery of the fixing portion.

* * * * *